United States Patent [19]

Bendell

[11] 3,994,033

[45] Nov. 30, 1976

[54] BEDSTEAD

[76] Inventor: Abraham David Bendell, 1 Kirkstone Avenue, Cullercoats, Whitley Bay, Tyne and Wear, England

[22] Filed: June 11, 1975

[21] Appl. No.: 586,133

[52] U.S. Cl. ..... 5/202; 5/58; 5/230

[51] Int. Cl.[2] ..... A47C 17/14

[58] Field of Search ..... 5/28, 29, 58, 59 R, 5/111, 112, 131, 200–202, 230, 329

[56] References Cited

UNITED STATES PATENTS

| | | | |
|---|---|---|---|
| 643,210 | 2/1900 | Tomlinson | 5/29 |
| 2,290,615 | 7/1942 | Firestone | 5/187 |
| 2,880,426 | 4/1959 | Goldstein | 5/58 |
| 3,037,215 | 6/1962 | Pile | 5/111 |
| 3,096,528 | 7/1963 | Inco | 5/28 |
| 3,636,574 | 1/1972 | Kramer | 5/191 |

*Primary Examiner*—Casmir A. Nunberg
*Attorney, Agent, or Firm*—Steinberg and Blake

[57] ABSTRACT

A bedstead is provided lending itself to incorporation with a decorative divan base or the like plinth, with or without drawers the plinth base having a rectangular ledge supporting a T-sectioned frame whose outwardly extended leg is supported on the ledge inwardly of which the mattress springs are thereby supported in one embodiment a longitudinal support member dividing the mattress support frame into two parts for facilitating transport and avoiding any tendency for two occupants to roll together when they do not wish to and permitting increased firmness for one of the occupants.

7 Claims, 4 Drawing Figures

BEDSTEAD

This invention concerns improvements in or relating to bedsteads and more especially to divan or the like beds having an upholstered or other decorative plinth surrounding the support for the mattress.

For very many years, bedsteads were produced having a wire mesh mattress support connected around its edges to a rectangular angle-iron frame by tension springs hooked into holes in the flange of the frame. The frame was formed at each end with a pair of connectors forming part of an e.g. dovetail joint, the other parts of the joints being formed on bed ends having legs. Such old fashioned beds have largely been replaced by unsprung bases for interior sprung mattresses and by beds having U-shaped cross-members from which coil compression springs extend upwardly to directly support the wire mesh and overlying mattress. Such springs are prone to burst the wire mesh, and penetrate the mattress and become displaced and consequently deformed in use to become detached. This results in sagging and ineffective support and an often undesirable tendency in use for two occupants to roll together when they do not wish to.

In addition, the manufacture of these sprung frames requires recondite and expensive equipment.

According to this invention, a bedstead comprises a base frame or plinth providing a rectangular ledge, a T sectioned mattress support frame having an outwardly extending web resting on the ledge and an inwardly extending web connected to the ends of inwardly extending springs which support a mattress support web within the support frame.

In one embodiment, in order to avoid inadvertent rolling of one occupant of a double bed towards the other, a longitudinal support member extends between the frame ends and this divides the mattress support web into two parts.

The ends of the mattress support frame may be discontinuous for use with a plinth, permitting one side to be folded upwardly for access to the base frame, and the mattress support frame may be provided with pivots to effect folding and facilitate carrying of the frame.

The longitudinal support member may be of T-section, and respective mattress support webs are connected at their adjacent edges to the adjacent arms of the T, the centre web of which is preferably deeper than the sides and ends of the frame, e.g. of iron and twice as deep.

The base frame may comprise a plinth of box form with decorative e.g. upholstered walls, or draped fabric, in any case a supporting ledge may be provided e.g. by wooden battens or uprights and the sides preferably extend above the ledge so as to provide a recess for housing the mattress support frame.

A cover is preferably provided for overlaying the mattress support web and for protecting the mattress or divan cushion, and for this, hessian may be employed having a layer of foamed plastics or rubber bonded to it.

Embodiments of the invention will now be described by way of example with reference to the accompanying drawings, wherein.

Figure 1:
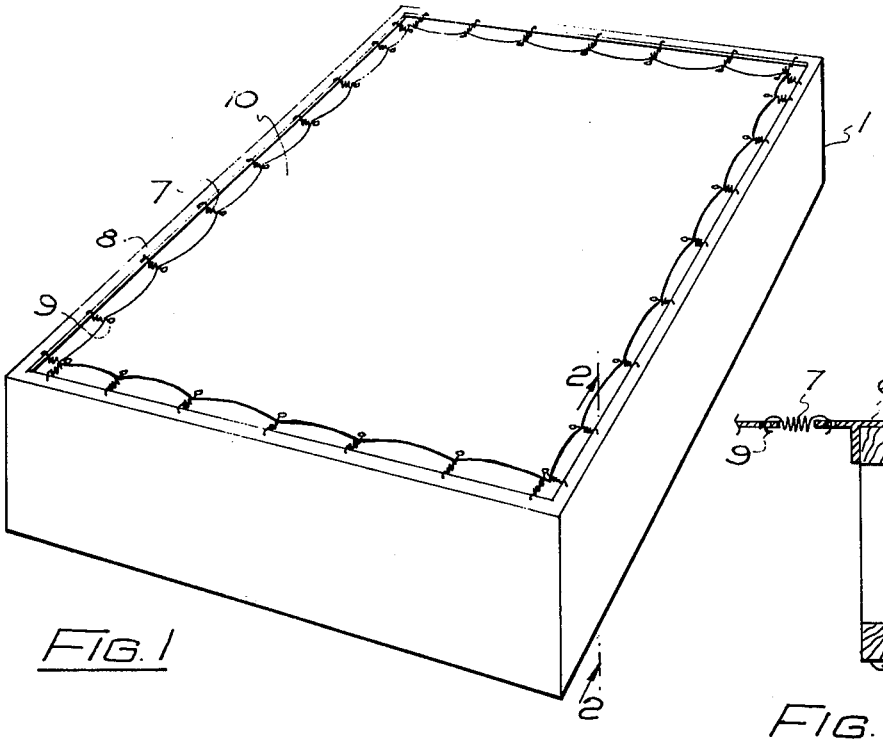
FIG. 1 is a perspective view from above a bedstead according to the invention.
Figure 2:
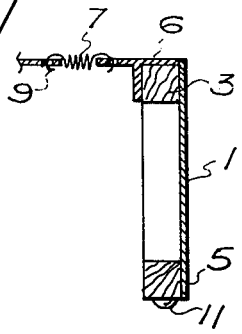
FIG. 2 is a section on line 2—2 of FIG. 1.

The bedstead shown in FIGS. 1 and 2 comprises a wooden base frame or plinth 1 having upper and lower support battens 3 and 5 respectively. The upper batten 3 provides a ledge, which supports a T-sectioned iron frame 6, one outwardly directed flange of which rests on the ledge. The batten 3 is located below the upper edge of the base frame wall 1 to allow the upper edge to be flush with the upper surface of the T-sectioned frame 6.

Mattress support springs are connected to holes 8 and 9 in the frame 6, and a mattress support web 10 respectively. Eyelets are provided in web 10 to receive the springs. The web 10 comprises a sheet of plastics material. The lower batten 5 is provided with a runner 11 to facilitate movement of the bedstead.

Figure 3:
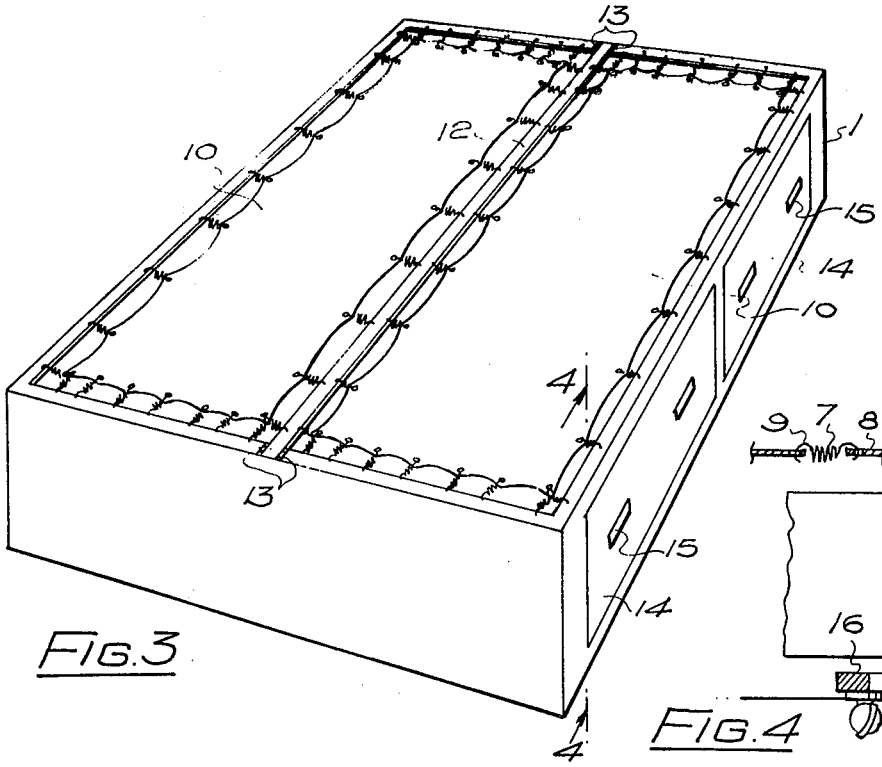
FIG. 3 is a perspective view from above of a double bedstead according to the invention.
Figure 4:
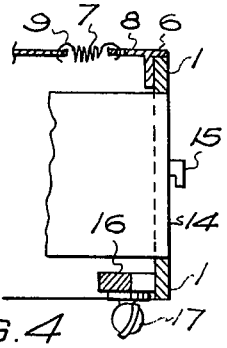
FIG. 4 is a section on the line 4—4 of FIG. 3.

In FIGS. 3 and 4 is shown a double bedstead comprising a wooden base frame or plinth 1 on which a T-sectioned iron frame 6 is seated. The frame 6 is in two halves pivotable about a longitudinal support member 12 on hinges 13 to allow upward folding for access to the interior of the base or plinth and to facilitate transport of the bedstead.

Mattress support springs 7 are connected between holes 8 in the T-section frame 6 and the longitudinal support member 12, and eyelets 9 in the support webs 10.

Storage drawers 14 having handles 15 are provided in the plinth 1.

Across each corner of the base frame or plinth 1 extends a castor support batten 16 on which a castor 17 is secured.

The invention permits the use of the satisfactory old fashioned edge-sprung interlaced wire mattress support in the more attractive setting of a divan bed, and for use in a double bed, possibly allowing the use of different spring tensions to suit the requirements of each occupant. The invention makes possible a rigid yet easily manufactured bedstead and mattress support which can either be a plastics sheet as described, or a wire mesh, and provides a durable satisfactory support.

What is claimed is:

1. A bedstead comprising a hollow plinth base of rectangular configuration having opposed elongated sides and opposed elongated ends extending between said sides, said base providing a rectangular ledge extending along said sides and ends of said base and having an inner free side surface and an opposed outer side surface, a T-sectioned mattress support frame having an outwardly extending web resting on the ledge and extending continuously therealong at the opposed sides of said base and at least partly from said opposed sides along said opposed ends of said base, said outwardly extending web terminating in an outer free edge which is substantially in alignment with said outer surface of said ledge, said frame having an inwardly extending web for supporting a mattress, said inwardly extending web forming an integral extension of said outwardly extending web and being situated in the same plane as said outwardly extending web, and said frame having also an integral downwardly extending web which extends continuously along said inner free surface of said ledge at said opposed sides of said base and from the latter at least partly along said opposed ends of said base, said support frame cooperating with said ledge only by resting thereon at said outwardly extending web of said frame while said downwardly extending web thereof cooperates with said inner surface of said ledge to prevent any substantial horizontal shifting of said frame with respect to said base.

2. A bedstead according to claim 1 in which said inwardly extending web is connected to the ends of inwardly extending springs which support a mattress support web within the support frame.

3. A bedstead according to claim 2 having a longitudinal support member extending between the ends of the support frame, and spaced between the side members thereof.

4. A bedstead according to claim 3 wherein one side of the mattress support frame is upwardly hingable for access to the interior of the plinth base.

5. A bedstead according to claim 3 wherein the longitudinal support member is of T-section, seperate mattress supports webs being connected to each flange of the T.

6. A bedstead according to claim 1 wherein the plinth base is of box form with decorative walls.

7. A bedstead according to claim 1 in which said mattress support frame has discontinuous ends, and pivots are provided thereon for effecting folding of the frame.

* * * * *